US011858672B2

(12) United States Patent
Joseph et al.

(10) Patent No.: US 11,858,672 B2
(45) Date of Patent: Jan. 2, 2024

(54) CARTRIDGE FLUID FILLING SYSTEM AND METHOD

(71) Applicant: DETROIT DISPENSING SOLUTIONS LLC, Bloomfield Hills, MI (US)

(72) Inventors: Christopher Joseph, Bloomfield Hills, MI (US); Michael Joseph, Bloomfield Hills, MI (US)

(73) Assignee: DETROIT DISPENSING SOLUTIONS LLC, Bloomfield Hills, MI (US)

( * ) Notice: Subject to any disclaimer, the term of this patent is extended or adjusted under 35 U.S.C. 154(b) by 273 days.

(21) Appl. No.: 17/502,739

(22) Filed: Oct. 15, 2021

(65) Prior Publication Data

US 2023/0121014 A1 Apr. 20, 2023

(51) Int. Cl.

| | |
|---|---|
| ***B65B 3/14*** | (2006.01) |
| ***A24F 40/70*** | (2020.01) |
| ***B65B 3/30*** | (2006.01) |
| ***B65B 3/24*** | (2006.01) |

(52) U.S. Cl.

CPC ..... *B65B 3/14* (2013.01); *A24F 40/70* (2020.01); *B65B 3/24* (2013.01); *B65B 3/30* (2013.01)

(58) Field of Classification Search

CPC .... B65B 3/14; B65B 3/24; B65B 3/30; B65B 3/12; B65B 3/32; B65B 7/2821; B65B 43/46; B65B 43/54; B65B 3/003; A24F 40/70

See application file for complete search history.

(56) References Cited

U.S. PATENT DOCUMENTS

| | | | | |
|---|---|---|---|---|
| 4,871,001 | A * | 10/1989 | Nobuta | B65B 1/22 222/536 |
| 9,283,324 | B2 | 3/2016 | Lev et al. | |
| 10,058,124 | B2 | 8/2018 | Monsees et al. | |
| 10,279,934 | B2 | 5/2019 | Christensen et al. | |
| 10,327,479 | B2 | 6/2019 | Popplewell et al. | |
| 10,561,172 | B2 | 2/2020 | Armoush et al. | |
| 10,865,001 | B2 | 12/2020 | Atkins et al. | |
| 11,083,857 | B2 | 8/2021 | Ampolini et al. | |
| 2017/0121169 | A1* | 5/2017 | Dailey | B65B 57/145 |

(Continued)

FOREIGN PATENT DOCUMENTS

| | | |
|---|---|---|
| EP | 3046838 | 7/2016 |
| WO | WO-2022183279 A1 * | 9/2022 |

*Primary Examiner* — Anna K Kinsaul
*Assistant Examiner* — Himchan Song
(74) *Attorney, Agent, or Firm* — Brooks Kushman P.C.

(57) ABSTRACT

A cartridge fluid filling system and method for the cannabis and hemp industry. The system comprises a gas-pressurized sanitary reservoir sub-assembly holding material to be dispensed. A spool valve sub-assembly lies in fluid communication with the reservoir sub-assembly and has a spool valve that moves to permit or block fluid flow to a metering rod. Effluent material may pass through an outlet port to a tray sub-assembly for locating cartridges into which metered amounts of the effluent material may be delivered. A robot moves a tray and the outlet port so that material is delivered in precisely metered amounts to cartridges in the tray without waste and in the absence of air bubbles. A human-machine interface includes controllers that supervise related process parameters.

14 Claims, 8 Drawing Sheets

(56) References Cited

U.S. PATENT DOCUMENTS

| | | | | |
|---|---|---|---|---|
| 2017/0251718 | A1* | 9/2017 | Armoush | A24F 40/40 |
| 2019/0014824 | A1 | 1/2019 | Yazbeck et al. | |
| 2019/0183181 | A1 | 6/2019 | Guenther, Jr. et al. | |
| 2020/0000143 | A1 | 1/2020 | Anderson et al. | |
| 2021/0267265 | A1* | 9/2021 | Partansky | A24C 5/608 |

* cited by examiner

CARTRIDGE FLUID FILLING SYSTEM AND METHOD

TECHNICAL FIELD

The present disclosure generally relates to an e-cigarette cartridge fluid filling system and method. In at least one embodiment, this disclosure describes a system for transferring fluid from a sealed reservoir in metered amounts to cartridges, pods, capsules, and syringes that are capped after the fluid is dispensed.

BACKGROUND

E-cigarettes use a fluid-filled cartridge containing an atomizer or heating element which attaches to a battery. The fluid is vaporized in the e-cigarette and inhaled by the user.

In practice, before filling, a starting material in bulk form may be in a semi-solid or viscous state at room temperatures. Such a state may complicate the steps of delivery through tortuous assemblies without changes to its chemical properties. Heat may enhance fluidity. But if heated excessively, the starting material may undergo unwanted phase changes and degradation.

Thus, the e-cigarette manufacturer seeks a reliable system in which the fluid delivered to the cartridge and from the cartridge to the user in a vapor state is transported from a starting reservoir to the cartridge hermetically and in precisely metered quantities. Ideally, such transfer should be made without waste and without degrading the fluid to be metered out.

In transit, the fluid should remain chemically stable, while retaining its fluidity and should undergo no change of state. One concern arising from past practices is that elevated temperatures tend to degrade the material, its flavor and aroma.

Further, it would be desirable to transfer the fluid from a reservoir to the cartridge efficiently and safely. For manufacturing economies, operations should be performed in batch assemblies of cartridges, rather than singularly.

SUMMARY

A cartridge filling and optional capping system for the cannabis and hemp industry is disclosed. In an exemplary embodiment, the system has these sub-assemblies: a reservoir tank sub-assembly, a spool valve sub-assembly, a metering rod region, a tray sub-assembly, a robot sub-assembly and a capping sub-assembly.

In one embodiment, the system includes a main frame that supports a gas-pressurized sanitary reservoir sub-assembly ("reservoir") which holds viscous or semi-solid material to be transferred towards an array of cartridges, pods, or capsules (collectively "cartridges") that are supported by wells in a tray. Optionally, the cartridges may be re-positioned for subsequent handling by a capping step.

The reservoir has a plurality of heaters that are mounted successively in such a way to deliver thermal energy to the material in a relatively uniform manner so that the material has minimal temperature gradients throughout the system. Such thermal energy enhances the ability of the material to flow, while retaining its chemical properties.

Also in conjunction with the reservoir tank are one or mixers that homogenize the material and allow it to retain its properties over time while awaiting transfer between and within subsequent sub-assemblies in the system, and while awaiting a dispensing step.

To determine a level of material in the reservoir, one or more level sensors are provided. Those sensors send signals indicative of fluid level to a PLC (programmable logic controller). To measure and monitor the temperature of material at various locations along a flow path, one or more temperature sensors are also provided. Those sensors send a temperature signal preferably to a multi-loop PID (Proportional Integral Derivative) controller.

A spool valve sub-assembly is attached to a robot that is secured in relation to the main frame. The spool valve sub-assembly has a spool valve that is enclosed in a housing. The housing contains a material inlet port, a metering rod, and a material outlet port. The material inlet port lies in fluid communication with the reservoir via a heated hose.

The spool valve has two positions to commonize different fluid pathways within the housing. In use, the spool valve while in position one, receives material from the reservoir via the material inlet port and distributes effluent material to a region of the housing that contains the metering rod. The spool valve is displaced in a cylinder by a gas pressure supply means such as a pump or compressor to shift the spool valve from position one (a loading position) to position two (a dispensing position). Position two of the spool valve puts the metering rod in fluid communication with the material outlet port, which allows effluent material to pass from the spool valve sub-assembly.

The metering rod region of the spool valve sub-assembly housing has a chamber that receives the metering rod and creates a space which accommodates different shot sizes of material to be dispensed. The metering rod region lies in fluid communication with the material inlet port and the material outlet port of the spool valve sub-assembly, depending on the position of the spool.

The metering rod region cooperates with an electric linear actuator that is in communication with the metering rod for extending and retracting the metering rod, thus creating different shot sizes depending on the length of the rod retraction.

To locate cartridges to be filled, a tray sub-assembly is secured to the robot. Metered amounts of the effluent material are delivered toward the tray from the metering rod region via the spool valve sub-assembly.

If desired, a capping sub-assembly is placed in relation to the tray for affixing caps on the cartridges.

To monitor and control the system, a human-machine interface ("HMI") and a programmable logic controller ("PLC") are provided. The PLC includes one or more controllers that receive signals from sensors stationed proximate the reservoir tank sub-assembly, the spool valve sub-assembly, the metering rod region, the tray sub-assembly and, if present, the capping sub-assembly. The one or more controllers receive and process such signals before generating command signals for controlling process parameters associated with reservoir tank sub-assembly, the spool valve sub-assembly, the metering rod region, the tray sub-assembly and the capping sub-assembly.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale. Some features may be exaggerated or minimized to show details of particular components. Therefore, specific structural and functional details disclosed herein are not to be interpreted as limiting, but merely as a representative basis for teaching one skilled in the art to variously employ the present invention.

Most embodiments of this disclosure relate to a cartridge filling and an optional capping system, primarily for the cannabis and hemp industry.

Figure 1:
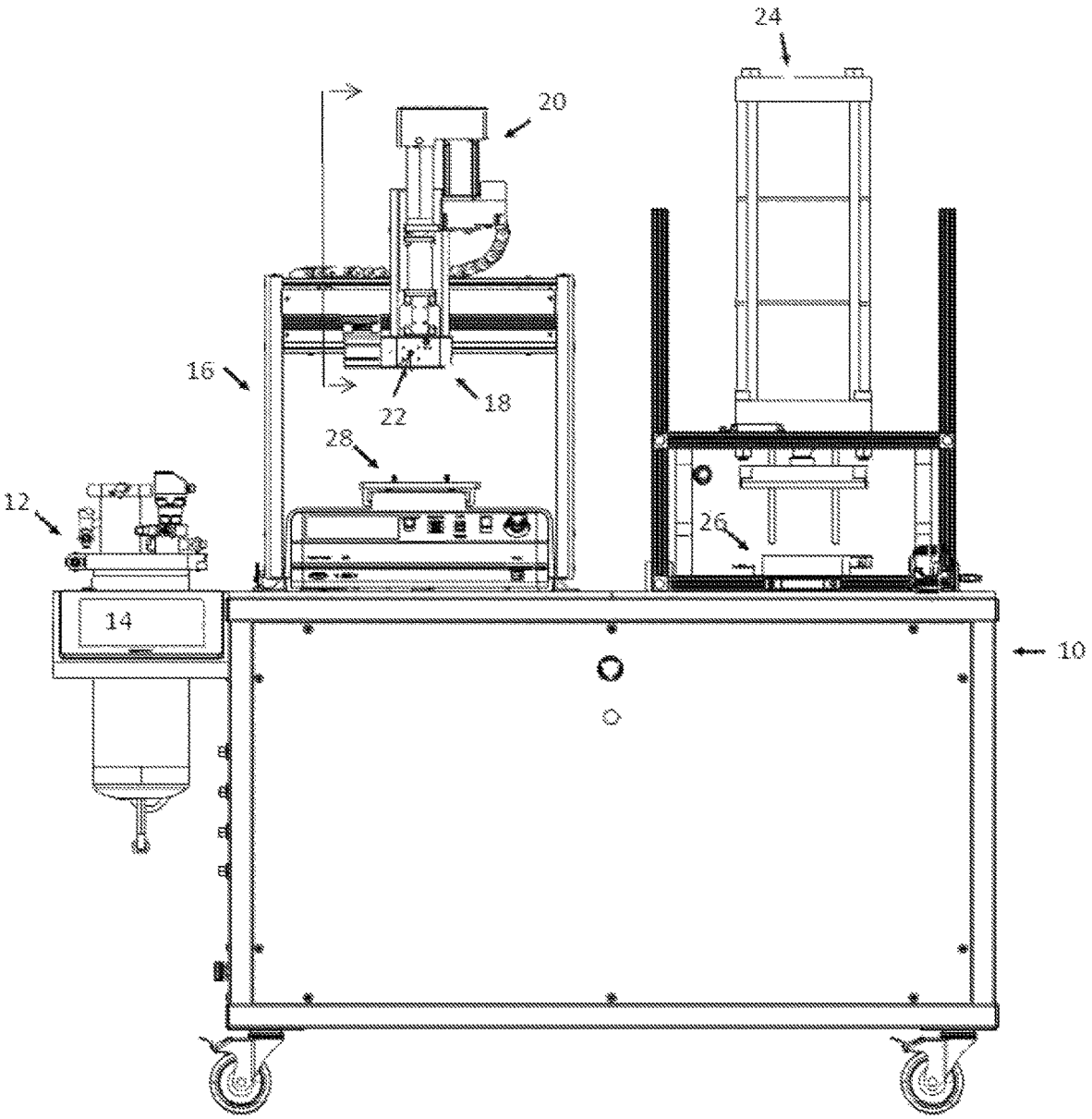
FIG. 1 is a front view of one embodiment of an assembly or system for transferring fluid from a sealed reservoir in metered amounts to cartridges, pods, capsules and syringes (collectively, "cartridges") that optionally are capped after the fluid is dispensed.
Figure 3:
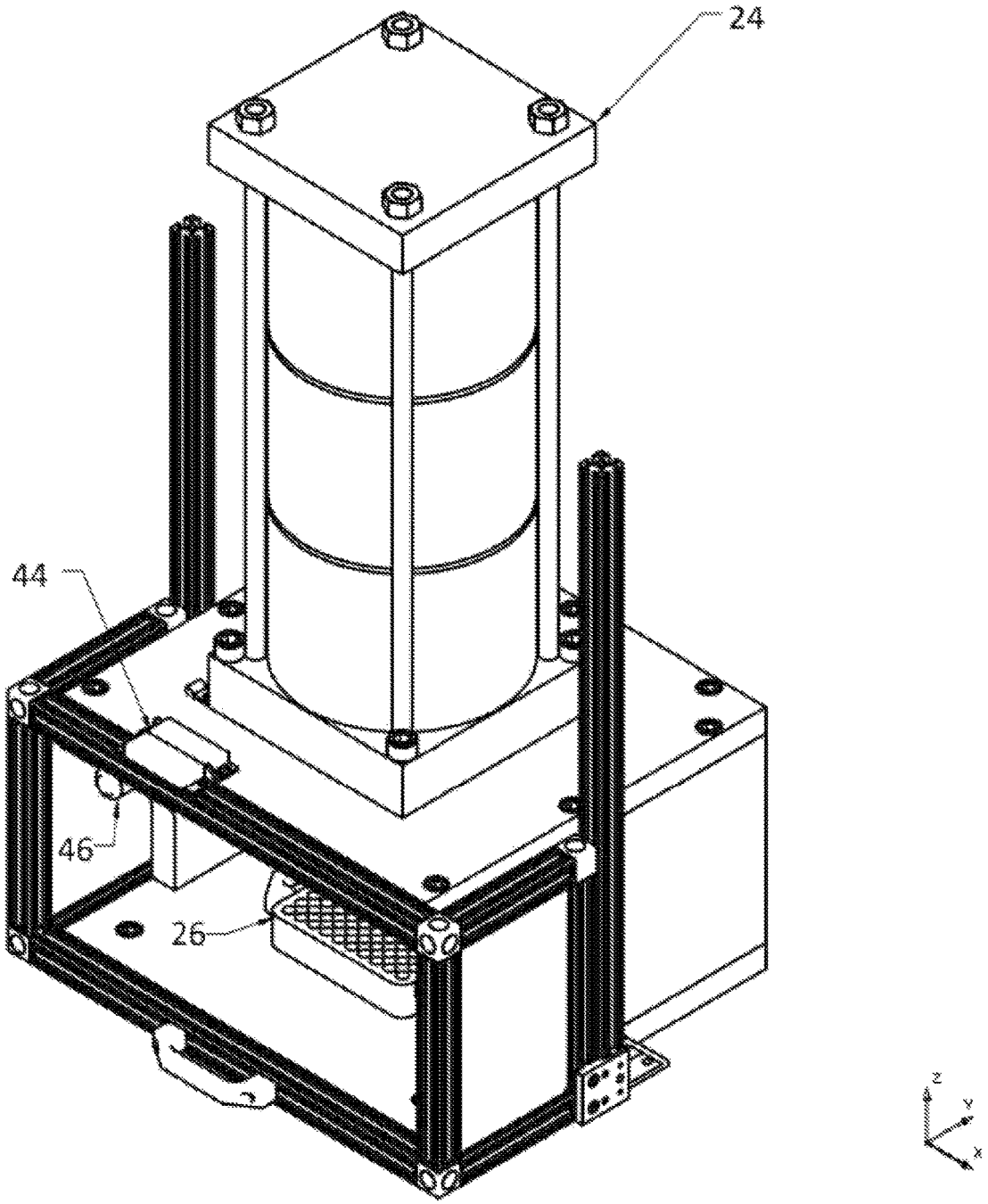
FIG. 3 is a perspective view of an optional capping sub-assembly.

In one embodiment, the system (FIGS. 1, 3) includes a main frame 10 that supports a gas-pressurized sanitary reservoir sub-assembly 12 which holds viscous or semi-solid material to be transferred towards a tray 26 containing array of cartridges (FIGS. 1, 3). In some embodiments, the cartridges on tray 26 may be exposed to a capping step that occurs at a capping sub-assembly 24. The main frame also supports a human-machine interface 14, a robot 16, and an optional capping sub-assembly (FIG. 3).

For reference, imagine a set of Cartesian coordinates (FIG. 3) in which the X-axis is horizontal (i.e., left-right), the Y-axis moves orthogonally into the plane of the paper, and the Z-axis is vertical.

Figure 2:
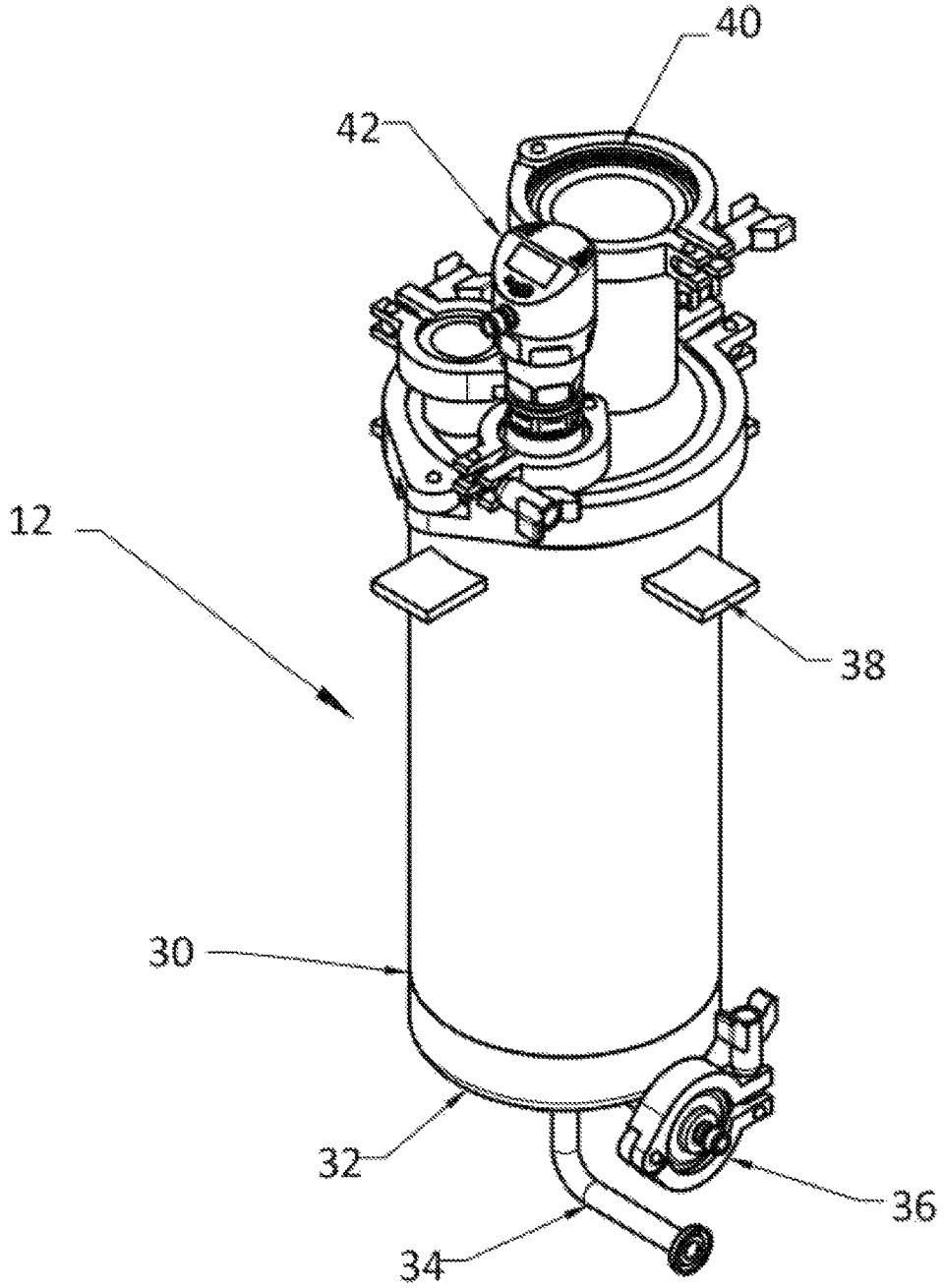
FIG. 2 is a perspective view of a reservoir sub-assembly.

The reservoir tank sub-assembly 12 is generally cylindrical and is supported in parallel with the Z-axis. Such support is offered by flanges or locating tabs 38 (FIG. 2) that extend outwardly from the reservoir 12 and engage the main frame 10. The reservoir 12 has a plurality of heaters 30, 32 and 34 (FIG. 2) that are mounted successively in such a way to impart and distribute thermal energy to the material in a uniform manner. One heater 30 is preferably a band heater that is situated in a lower position in the cylinder. This heater 30 is activated in response to a sensed fluid level in the reservoir 12. In this way, problems associated with overheated material that adheres to the inside reservoir walls are avoided, as are unwanted temperature spikes. In one embodiment, the heater 32 is a mounted at a bottom region of the reservoir 12.

With the aid of a coordinated array of heaters, the material may be desirably stored and transported within the system at temperatures below 100 degrees Fahrenheit. Such thermal energy enhances the ability of the material to flow while retaining its chemical properties. Preferably, the heater 34 includes a thermocouple and is fitted proximate a discharge port 34 through which heated material is transferred from the reservoir 12.

To energize the heaters 30, 32 and 34, temperature sensors 36 (FIG. 2) are provided that are in electrical connection with a controller. Sensors may for example be resistance temperature detectors (RTD's). The connection may be hard wired or wireless via Bluetooth. Temperature monitoring may be continuous or be at periodic intervals. The controller has an ability to receive signals indicative of temperature and store desired and actual temperature levels for at least some of the heaters 30, 32 and 34. When the actual temperature level detected by a sensor is less than that desired, an electrical circuit is closed that includes a source of electrical energy and a heating element. Heat is then delivered by the heating element. A human-machine interface (HMI, FIG. 1) 14 allows an operator to input desired temperatures at each sensor and report to the operator the actual temperatures sensed at each sensor location. Such features allow the material to be retained in a homogeneous state and avoid being burned on a vessel interior or conduit walls.

Material to be retained and dispensed is initially loaded into the reservoir 12 through an inlet port. Such a port is sized to accommodate entry of a viscous or semi-solid material. In one embodiment, a 5-liter reservoir is used. After loading to a full or semi-filled state, the inlet port is closed to provide a hermetically sealed environment.

Before heating, the material is in an initial, at least partially fluid state. During and after retention for a desired period, the material becomes less viscous and assumes a secondary state in which it is transferred from the reservoir 12 through a material discharge port 34 for subsequent handling.

The reservoir is pressurized, preferably using air that has passed through a sanitary filtration system to aid in the movement of the fluid through the material outlet port 34. In one embodiment, air under pressure passes through one or more three stage sterile air filters, such as a Balston 3BB-2002N-3B1. An air inlet port is mounted preferably at an upper region of the reservoir 12. This port delivers a clean gas such as air or nitrogen for pressurizing the tank and aiding in the movement of material through the tank and to a heated material outlet 34.

Figure 8:
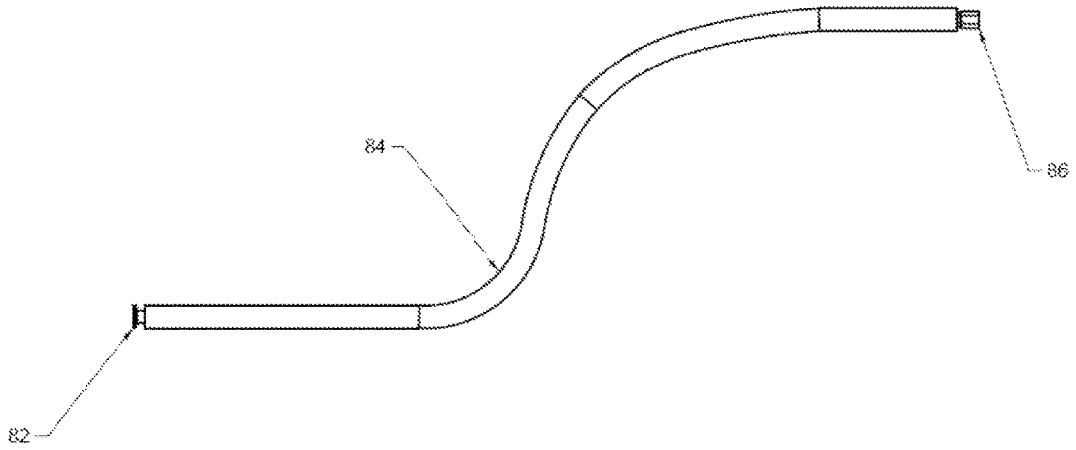
FIG. 8 is a hose sub-assembly with a heater, thermocouple, and thermal insulation

A heated hose sub-assembly FIG. 8 lies in fluid communication with the material outlet 34 of the reservoir tank, and the material inlet 22 of the spool valve sub-assembly. The hose assembly is wrapped with a heater with a thermocouple, as well as a thermal insulation.

If desired, to promote homogeneity and uniform temperatures, one or more mixers 40 are provided in the reservoir 12. Before transference from the reservoir 12 the mixers 40 allow the material to retain its properties over space and time while awaiting transfer between and within subsequent sub-assemblies in the system, and ultimately awaiting a dispensing step.

To determine a level of material in the reservoir, one or more level sensors 42 (FIG. 2) are provided. Those sensors send signals indicative of fluid level to the controller. In some embodiments, guided wave radar level sensors are provided. Some examples are described at https://www.ifm.com/us/en/us/learn-more/level/lr-learn-more, which is incorporated by reference. The level sensor 42 operates in conjunction with the reservoir heaters 30, 32 and 34 to determine the amount of thermal energy to impart to the reservoir A spool valve sub-assembly 18 (FIGS. 1, 4-6) is attached to the robot 16. The spool valve sub-assembly 18 has a spool valve 62 or spindle that can move parallel to the X-axis. In use, the spool valve sub-assembly 18 receives material from the reservoir 12, distributes the material to a metering rod region, and dispenses metered amounts of material, preferably through a hollow needle 90 (FIG. 4) to awaiting cartridges.

The spool valve sub-assembly 18 has a material inlet port 22 (FIGS. 1, 5) that lies in fluid communication with the reservoir 12. In series with the spool valve 18 is metering rod region 54 (FIG. 4) with a chamber that receives a metering rod 64. A metering chamber inlet port is fluidly connected to the chamber. Inside the spool valve sub-assembly 18 is a metering rod that is displaced, preferably using an electric linear actuator, so as to create volumetric areas to control the shot size.

The spool valve sub-assembly 18 thus controls fluid flow into and outwardly from the metering rod region. It includes a spool or spindle that moves linearly inside a cylinder which is mechanically or electrically actuated. The position of the spindle restricts or permits flow. The spindle has lands which block fluid flow and grooves that allow material to flow around the spindle to the metering chamber in the region that accommodates the metering rod.

The spindle normally travels in a left/right manner (i.e., in parallel with the X-axis) and has two positions: a normal position to which the spindle returns on removal of an actuating force, and a working position in which the spindle reposes when the actuating force is applied. The spindle remains in the position it was last in when the force was removed. To move the spindle, pneumatic pressure is applied to one of two sides of the spindle. Alternatively, the spindle moves when there is a pressure differential across its ends.

One model of a displacement metering machine is a CM420 Dispensing System, which is available from Fluid Research. See, e.g., www.fluidresearch.com/products/meter-mix-dispense-systems/cm420-multi-component-dispending-system, which is incorporated by reference.

Figure 4:
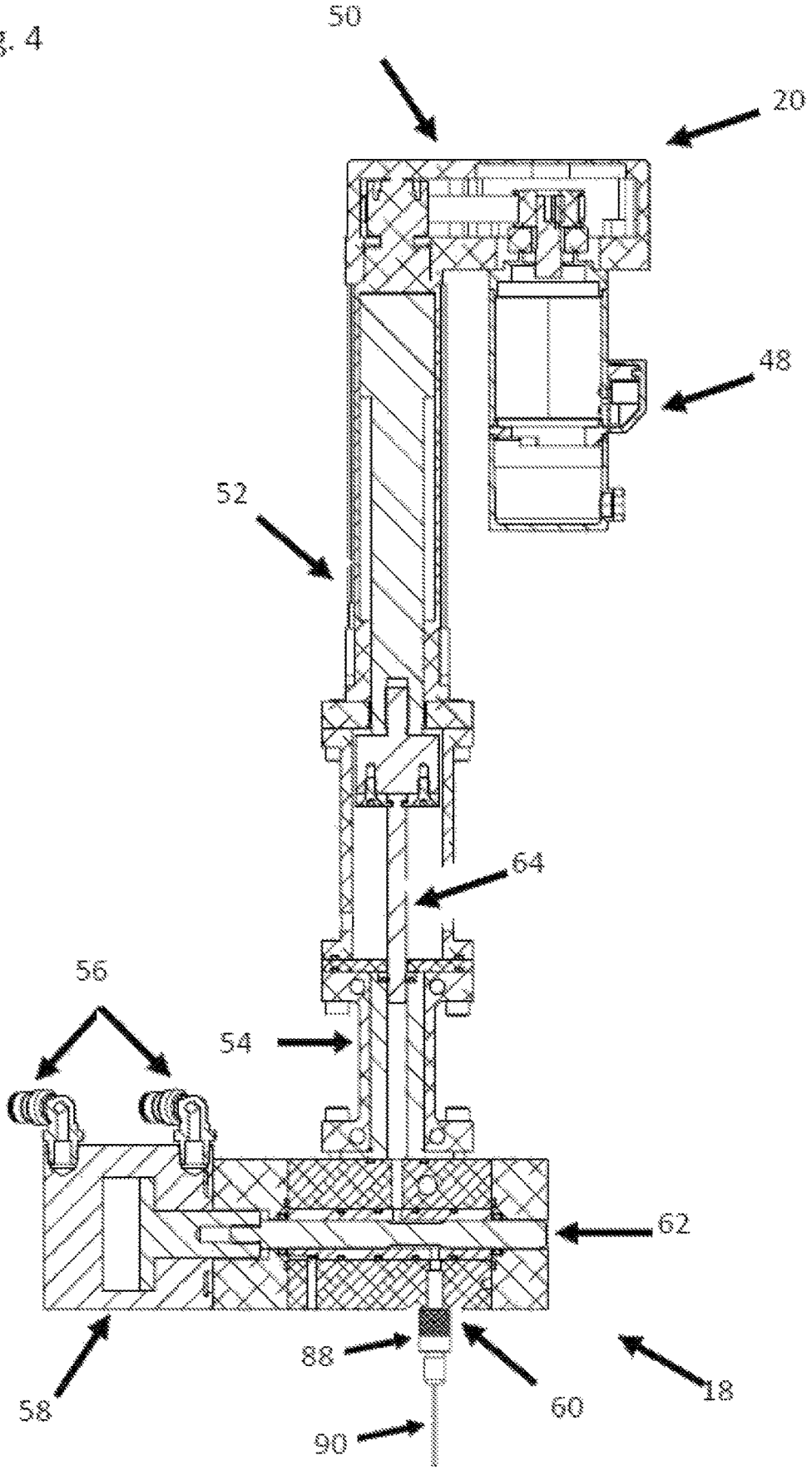
FIG. 4 is a front sectional view of a spool valve sub-assembly with a metering rod region and electronic linear actuator.
Figure 5:
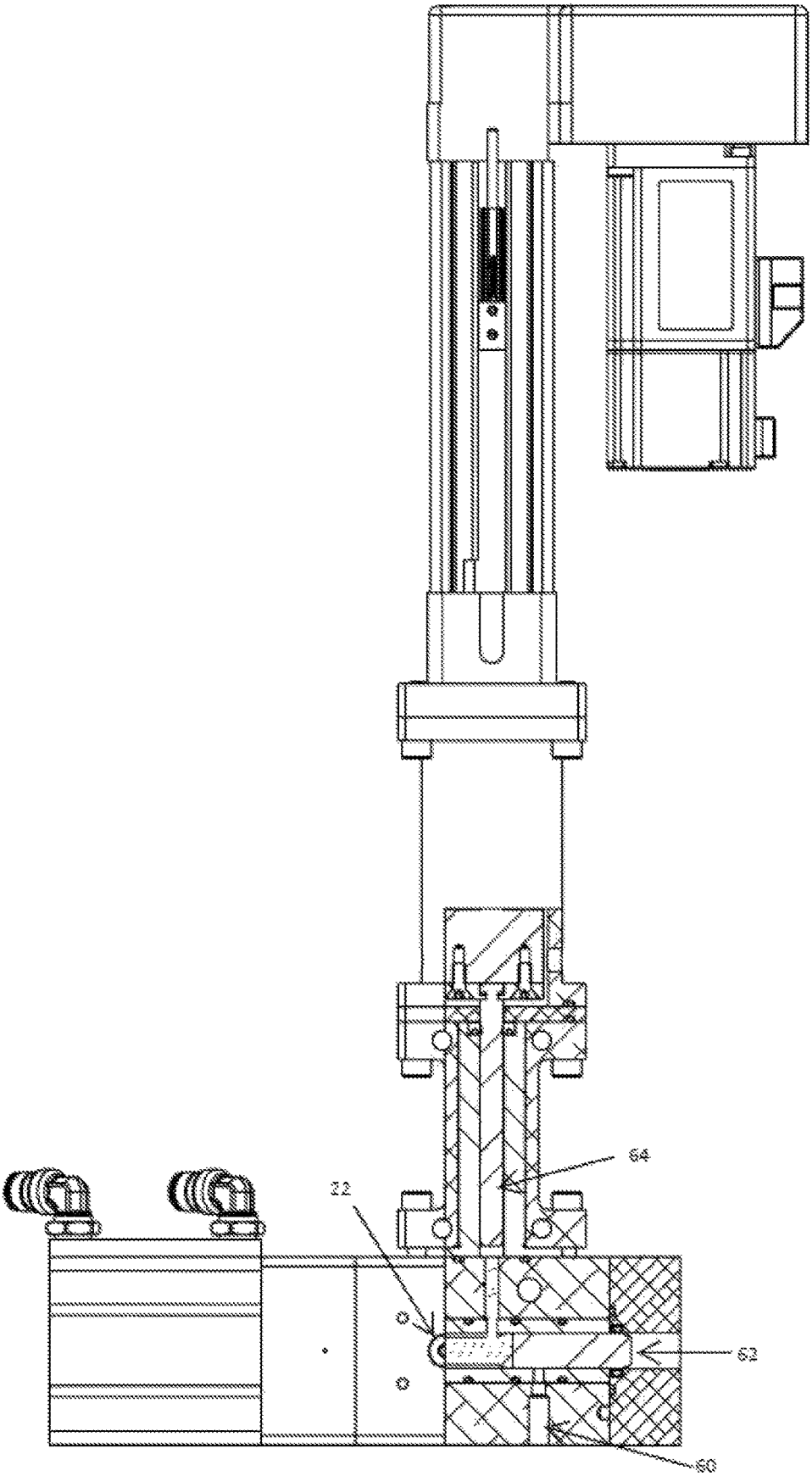
FIG. 5 is a front partially sectioned view of a spool valve sub-assembly with the spool valve in position one ("load"). The material inlet port and the metering rod region are in fluid communication.
Figure 6:
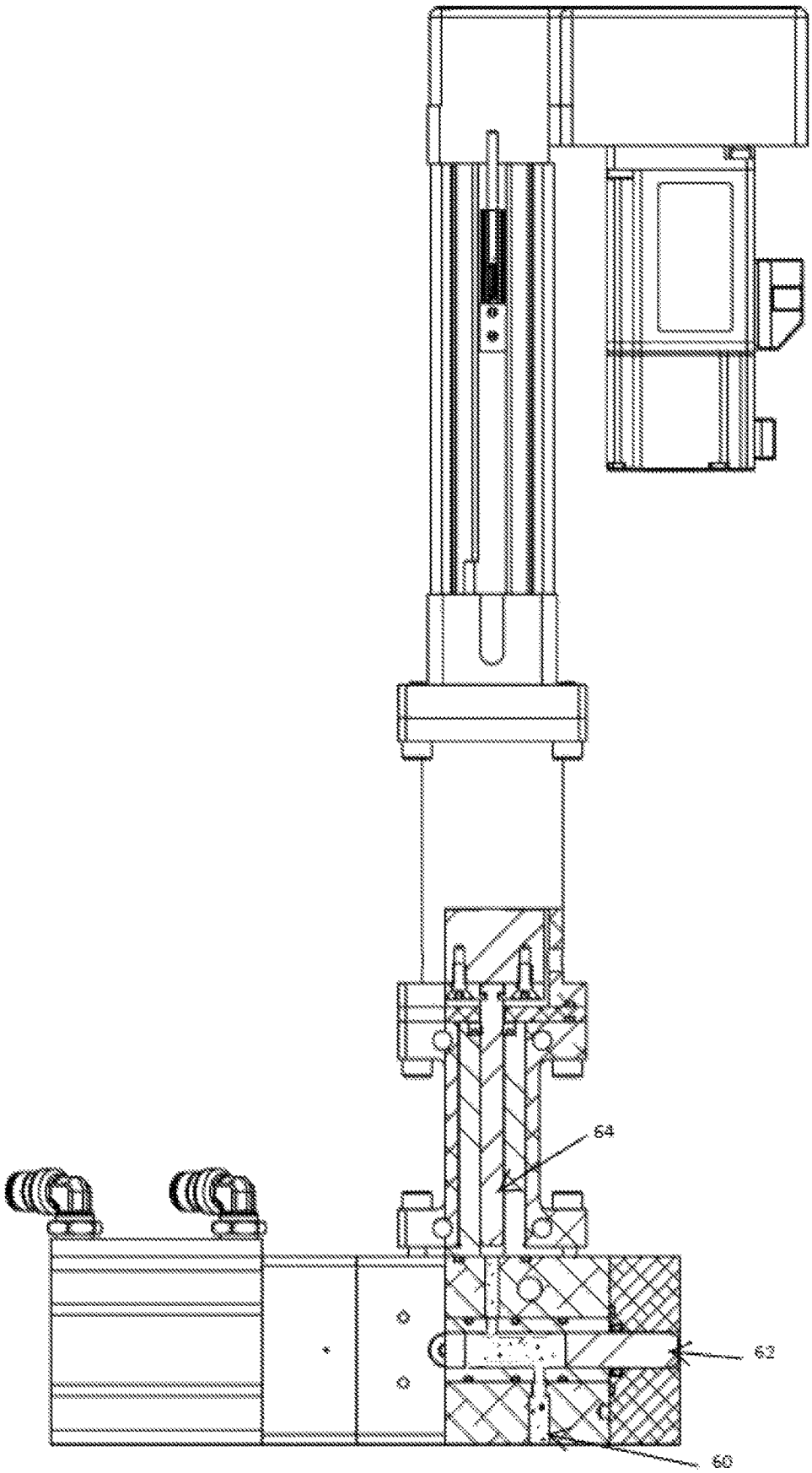
FIG. 6. is a front partially sectioned view of a spool valve sub-assembly with the spool valve in position two ("dispense"). The metering rod region and the material outlet port are in fluid communication.

A material outlet port 60 (FIG. 4) allows precise amounts of effluent material to pass from the metering chamber in quantified shot sizes. A hollow needle 90 may be attached to the material outlet port, preferably by a Luer lock adapter 88 (FIG. 4). The metering rod 64 (FIG. 4) travels in discrete amounts in response to a linear actuator 52. Thus, a predetermined volume of incompressible fluid is created for dispensing. The metering rod region 54 cooperates with the electric linear actuator 52 for extending and retracting the metering rod 64 by precisely determined amounts of displacement in the chamber. The resulting shot sizes then pass through a bottom region of the spool valve sub-assembly to a material outlet port 60 and then to a needle. In this region also, a temperature sensor is provided in cooperation with a heater that is activated by the controller. The controller monitors desired and actual operating parameters, such as temperatures and fluid levels. The HMI allows operator intervention if desired.

To locate cartridges to be filled, a tray sub-assembly 26 (FIG. 3) is secured to a robot 16 (FIG. 1). The robot 16 positions the spool valve sub-assembly outlet port 60 (FIGS. 4 and 6) above each individual cartridge in the tray 26. In one embodiment, the tray sub-assembly 26 may move in parallel with the X-axis or the Y-axis or to a location specified by its X-Y coordinates. Preferably a dispensing valve in communication with a material outlet 60 (FIG. 4) from the spool valve sub-assembly 18 moves in the X and Z directions. The tray 26 (FIG. 3) may move in parallel with the Y axis. Metered amounts of the effluent material from the metered outlet port 60 of the spool valve sub-assembly are delivered thereto.

Extending from the outlet port 60 is a hollow needle through which material flows in a metered amount to a cartridge. In one embodiment, a distal end of the needle lies in a lower portion of an awaiting cartridge. As flow commences, the needle retracts so that material delivery occurs below the material surface in the cartridge. In this way, no air pockets are formed in the material that is delivered to the cartridge.

The tray sub-assembly 26 accommodates machined, preferably aluminum or stainless steel, trays 26 with a number (N) of recesses, where 50>N>200, with N preferably =100. If the tray is made of aluminum, cartridges are preferably placed by hand. Alternatively, the trays may be made of plastic. In such cases, a robotic device 16 (FIG. 1) places the cartridges in the trays 26. Each recess accommodates one cartridge to be filled. In some embodiments, a capping step occurs before each cartridge is removed from the tray before loading into an e-cigarette.

One suitable robotic device is the F4303N Robot, which is available from Fluid Research. See, e.g., www.fluidresearch.com/products/meter-mix-dispense-systems/cm420-multi-component-dispensing-system, which is incorporated by reference. This robot attaches to the spool valve sub-assembly 18 for positioning the material outlet port 60 above each cartridge to be filled. The plastic trays preferably are populated with cartridges by a cartridge manufacturer at his facility.

Optionally, an automated setup can be provided in coordination with the spool valve sub-assembly 18 to place the cartridges into the trays 26. Such an arrangement spares the end user from the task of placing each cartridge individually into a tray.

Figure 7:
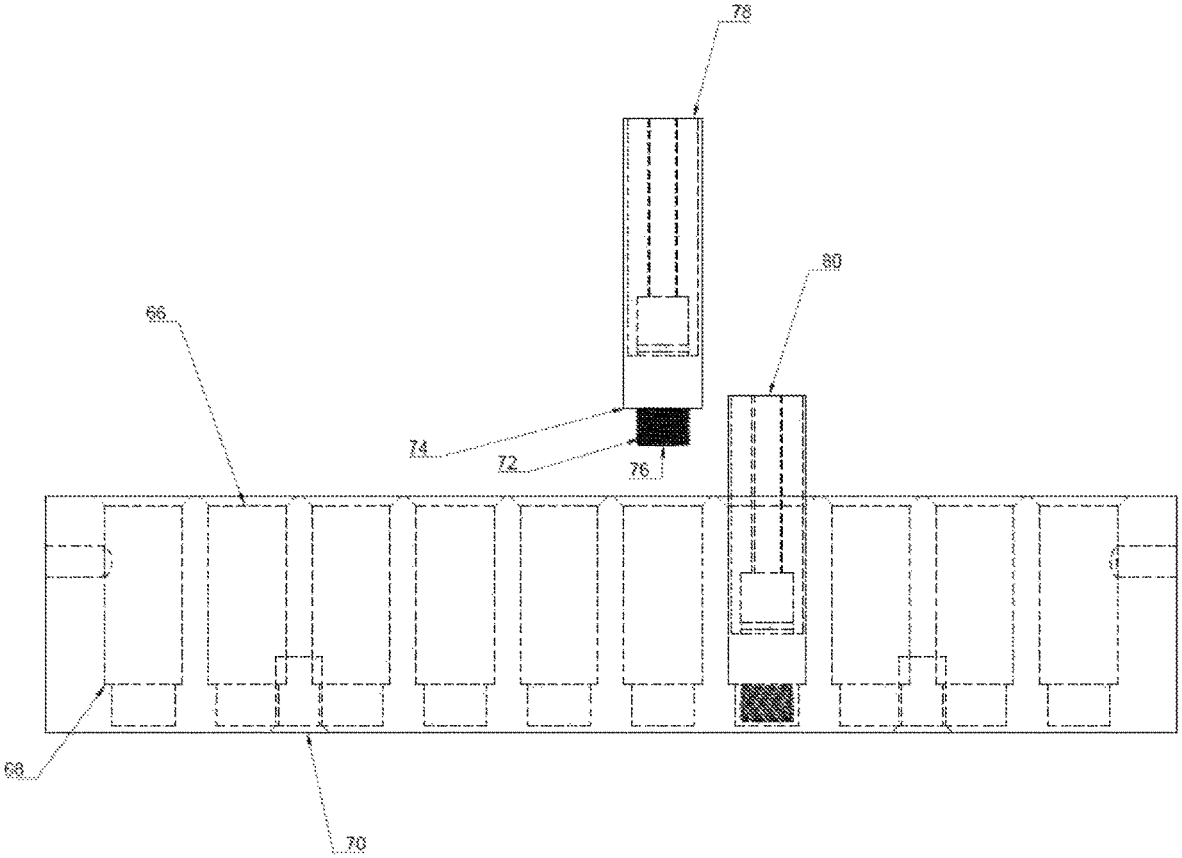
FIG. 7 is a vertical cross section of the sub-assembly of the tray of FIG. 3.

Turning now to FIG. 7, each cartridge has a lower end or lip 74 that is seated in the tray at position 66. Each cartridge has an upper end 80 that is designed to receive a cartridge cap. The lower end has an electrical contact 76 that acts as the positive lead for connection to a battery that lies in the e-cigarette. The threaded portion of the lower end 72 acts as the negative lead to the battery. Preferably, a potentially fragile electrical contact should be protected during the filling and any subsequent capping steps when a capping force is applied. In some cases, a positive lead 76 can be pushed upwardly into the cartridge if an excessive force is applied, thereby causing an electrical connection failure. To avoid such an adverse consequence, the lip 74 at the lower end of the cartridge is received by a shoulder 68 that is formed in each recess of the tray. Thus, when a downward force is exerted during the optional capping step, engagement of the lip by the shoulder bears the capping force, thus protecting an electrical contact.

In some embodiments, a threaded member provides a connection to a battery. The threaded member also acts as the negative lead for the electrical connection.

In one variant, with aluminum trays, each cartridge is placed in the tray by hand. After the cartridges in the tray have been filled, each cap is placed onto each cartridge individually by hand.

In another variant, with the plastic tray, there are two parts to each tray. One part contains for example 100 cartridges already in the tray. The second part has a like number of caps in a separate tray. After the cartridges are filled, the two trays use a keyed alignment system to guide all the caps onto all the cartridges at once. The trays position the caps in registration with the cartridges so the two trays can then be set into a press and thus complete the capping step.

In yet another variant, in readiness for a capping step, the trays are loaded with cartridges. Particularly when the tray is made of plastic, loading is optionally achieved with the aid of a robotic device that is in communication with the controller.

If desired, a capping sub-assembly includes a grasping feature that is placed in relation to the tray for affixing caps on the cartridges. The robotic device grasps a cap for each cartridge, repositions itself above a cartridge to be filled and moves downwardly towards the open end thereof, thus mounting the cap on the cartridge with a predetermined force or displacement. After the cap is inserted, the robotic device retracts, grasps another cap, and the capping step is repeated for subsequent cartridges in the tray.

If desired, the robotic device can be controlled in such a way as to slide a filled tray along a table or trolley and replace the filled tray with another tray.

Registration of each tray min in relation to a movable table or rails is achieved by positioning rounded corners or edges of each tray in relation to pins 28 (FIGS. 1 and 7) that are affixed to the table or tray. Such a keying feature helps align the trays in relation to the robotic device.

In use, trays are shipped to those ("end users") who have the disclosed system, the trays being populated with empty cartridges. To facilitate handling, at least some of the trays may be provided with handles, or recesses formed along opposing underside edges of the tray.

To monitor and control the system, a human-machine (HMI) interface and one or more processors are provided. In one embodiment, each processor includes one or more controllers that receive signals from sensors stationed proximate the reservoir sub-assembly, the spool valve sub-assembly, the metering rod region, the tray 26 and an optional grasping feature. The one or more controllers process such signals and generate command signals for controlling process parameters associated with reservoir tank sub-assembly, the spool valve sub-assembly, the metering rod region, the tray sub-assembly and the grasping feature.

A safety-rated controller interfaces with the capping sub-assembly. Digital proportional regulators are utilized to determine the amount of pressure present in the reservoir as well as control the amount of force the capping sub-assembly applies to the cartridges. In one embodiment, proportional-integral-derivative (PID) controllers handle temperature control and sensing and interface with the programmable logic controller (PLC). Digital and analog inputs and outputs pass between controllers and sensors via the HMI. DC power supplies are provided, as are circuit breakers for main power distribution. For safety, an emergency stop button is available.

The HMI permits control of the reservoir sub-assembly via a proportional regulator and a 3-way sanitary valve, the agitator via a solenoid, the spool valve sub-assembly by a 5/2 valve, and the capping sub-assembly via a proportional regulator and 5/3 valve.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

REFERENCE NUMERALS

10. Main frame
12. Reservoir sub-assembly
14. HMI with built-in PLC
16. Robot
18. Spool valve sub-assembly
20. Electric linear actuator
22. Material inlet for spool valve sub-assembly
24. Pneumatic cylinder for cartridge capping sub-assembly
26. Cartridge tray
28. Locating pins for cartridge tray
30. Cylindrical band heater
32. Bottom-mounted heater
34 Material outlet with heater and thermocouple
36. RTD temperature sensor directly in contact with material in tank
38. Locating tabs to position reservoir on main frame
40. Mounting point for optional mixer
42. Guided wave radar level sensor
44. Magnetically coded gate switch
46. Safety indicator light bar
48. Servo motor with integrated drivers and controllers
50. Reverse parallel motor mount
52. Linear actuator
54. Metering rod region
56. Air inlets for pneumatic cylinder
58. Pneumatic cylinder to shift spool valve position
60. Material outlet from spool valve sub-assembly
62. Spool valve
64. Metering rod
66. Position inside tray into which a cartridge is placed
68. Shoulder
70. Recess for locating pins 28
72. Threaded portion of the cartridge that acts as a negative lead
74. Lip on the cartridge where capping force should be applied
76. Positive lead of the cartridge located at the bottom
78. Portion of the cartridge which fluid would be dispensed
80. Top of the cartridge which will receive a cap
82. Connection of the heated hose sub-assembly to be attached to the reservoir
84. Heated hose sub-assembly with heater, thermocouple, and thermal insulation
86. Connection of the heated hose sub-assembly to be attached to the spool valve sub-assembly
88. Luer lock
90. Needle

We claim:

1. A cartridge filling and capping system for the cannabis and hemp industry, comprising:

a main frame;

a gas-pressurized sanitary reservoir sub-assembly attached to the main frame, the reservoir sub-assembly holding material to be dispensed and having one or more temperature sensors to observe a temperature level of the material;

one or more heaters to impart thermal energy to the material, thereby enhancing its ability to flow;

one or mixers to homogenize the material; and one or more level sensors to detect a level of material in the reservoir;

a spool valve sub-assembly in fluid communication with the reservoir sub-assembly, the spool valve sub-assembly having a spool valve, the spool valve sub-assembly receiving effluent material from the reservoir sub-assembly through a heated hose and having a material inlet port connected to the hose;

a housing fluidly connected to the material inlet port within which a spindle may move to permit or block fluid flow;

a metering rod region extending from the housing, the metering rod region including a chamber for receiving a metering rod, the metering rod region being in communication with an electric linear actuator for extending and retracting the metering rod, the metering rod region delivering precisely metered quantities of effluent material; and a material outlet port through which the effluent material may pass;

a tray sub-assembly secured to the main frame for locating cartridges into which metered amounts of the effluent material may be delivered;

a robot attached to the spool valve sub-assembly and the tray sub-assembly, the robot being adapted to position the tray while moving the material outlet port of the spool valve sub-assembly, the robot having locating pins to locate the tray;

a pneumatic cylinder in communication with the robot and placed in relation to the tray for affixing caps on the cartridges; and a human-machine interface including one or more controllers that receive signals from sensors located at positions selected from the group consisting of the reservoir sub-assembly, the spool valve sub-assembly, the metering rod region, the tray and the pneumatic cylinder;

process such signals; and generate control signals for influencing process parameters associated with an assembly of locations selected from the group consisting of the reservoir sub-assembly, the spool valve sub-assembly, the metering rod region, the tray, heaters, pressure regulators and the pneumatic cylinder.

2. The cartridge filling and capping system of claim 1, further including one or more filters for purifying air introduced into the reservoir sub-assembly.

3. The cartridge filling and capping system of claim 1, wherein the hose is heated when the one or more controllers receive a signal that indicates an actual temperature of material in the hose, compares that signal with a desired temperature and closes a heating circuit when the actual temperature is less than the desired temperature.

4. The cartridge filling and capping system of claim 1, wherein the spool valve sub assembly includes a spool valve that moves between two positions to commonize different fluid pathways within the housing.

5. The cartridge filling and capping system of claim 4, wherein the two positions include a first position in which the spool valve sub-assembly receives material from the reservoir sub-assembly and distributes effluent material to a region of the housing that contains the metering rod.

6. The cartridge filling and capping system of claim 4, wherein the two positions include a second position in which the spool valve puts the metering rod in fluid communication with the material outlet port, thereby allowing effluent material to pass from the spool valve sub-assembly.

7. The cartridge filling and capping system of claim 4, wherein the spool valve is displaced by a gas pressure supply means to shift the spool valve from the first position to the second position and from the second position to the first position.

8. The cartridge filling and capping system of claim 1, wherein the metering rod region cooperates with an electric linear actuator that is in communication with the metering rod for extending and retracting the metering rod, thus creating different shot sizes depending on a length of the rod retraction.

9. The cartridge filling and capping system of claim 1, wherein a hollow needle extends from the outlet port of the spool valve sub-assembly through which material flows in a metered amount to a cartridge.

10. The cartridge filling and capping system of claim 9, wherein a distal end of the needle lies in a lower portion of an awaiting cartridge so that as flow commences, the needle retracts and material delivery occurs below a material surface in the cartridge, thereby avoiding the formation of air pockets in the material that is delivered to the cartridge.

11. The cartridge filling and capping system of claim 1, wherein each cartridge has a lower lip that is seated in a shoulder portion of a well in a tray of the tray sub-assembly, an upper end for receiving a cartridge cap and a lower end with an electrical contact that acts as the positive lead for connection to a battery that lies in an e-cigarette, thereby protecting a potentially fragile electrical contact during filling and any subsequent capping steps when a capping force is applied, so that when a downward force is exerted during an optional capping step, engagement of the lower lip by the shoulder bears an associated capping force, thus protecting an electrical contact.

12. The cartridge filling and capping system of claim 1, wherein the robot slides a filled tray along a table and replaces the filled tray with another tray, each tray being placed in registration by positioning rounded edges of each tray in relation to pins.

13. A cartridge filling system for the cannabis and hemp industry, comprising:

a main frame;

a gas-pressurized sanitary reservoir sub-assembly attached to the main frame, the reservoir sub-assembly holding material to be dispensed and having one or more temperature sensors to observe a temperature level of the material;

one or more heaters to impart thermal energy to the material, thereby enhancing its ability to flow;

one or more mixers to homogenize the material; and one or more level sensors to detect a level of material in the reservoir;

a spool valve sub-assembly in fluid communication with the reservoir sub-assembly, the spool valve sub-assembly having a spool valve, the spool valve sub-assembly receiving effluent material from the reservoir sub-assembly through a heated hose and having a material inlet port connected to the hose;

a housing fluidly connected to the material inlet port within which a spindle may move to permit or block fluid flow;

a metering rod region extending from the housing, the metering rod region including a chamber for receiving a metering rod, the metering rod region being in communication with an electric linear actuator for extending and retracting the metering rod, the metering rod region delivering precisely metered quantities of effluent material; and a material outlet port through which the effluent material may pass;

a tray sub-assembly secured to the main frame for locating cartridges into which metered amounts of the effluent material may be delivered;

a robot attached to the spool valve sub-assembly and the tray sub-assembly, the robot being adapted to position the tray in cooperation with the material outlet port of the spool valve sub-assembly, the robot having locating pins to locate the tray; and a human-machine interface including one or more controllers that receive signals from sensors located at positions selected from the group consisting of the reservoir sub-assembly, the spool valve sub-assembly, the metering rod region, the tray and the pneumatic cylinder;

process such signals; and generate control signals for influencing process parameters associated with an assembly of locations selected from the group consisting of the reservoir sub-assembly, the spool valve sub-assembly, the metering rod region, the tray sub-assembly, heaters, and pressure regulators.

14. A method for filling cartridges used in e-cigarettes, comprising the steps of:

providing a main frame;

attaching a gas-pressurized sanitary reservoir sub-assembly to the main frame, the reservoir sub-assembly holding material to be dispensed and having one or more temperature sensors to observe a temperature level of the material;

one or more heaters to impart thermal energy to the material, thereby enhancing its ability to flow;

one or mixers to homogenize the material; and one or more level sensors to detect a level of material in the reservoir;

connecting a spool valve sub-assembly in fluid communication with the reservoir sub-assembly, the spool valve sub-assembly having a spool valve, the spool valve sub-assembly receiving effluent material from the reservoir sub-assembly through a hose and having a material inlet port connected to the hose;

a housing fluidly connected to the material inlet port within which a spindle may move to permit or block fluid flow;

a metering rod region extending from the housing, the metering rod region including a chamber for receiving a metering rod, the metering rod region being in communication with an electric linear actuator for extending and retracting the metering rod, the metering rod region delivering precisely metered quantities of effluent material; and a material outlet port through which the effluent material may pass;

securing a tray sub-assembly to the main frame for locating cartridges into which metered amounts of the effluent material may be delivered;

attaching a robot to the spool valve sub-assembly and the tray sub-assembly, the robot being adapted to position a tray parallel in cooperation with the material outlet port of the spool valve sub-assembly; and installing a human-machine interface including one or more controllers that receive signals from sensors located at positions selected from the group consisting of the reservoir sub-assembly, the spool valve sub-assembly, the metering rod region, the tray and the pneumatic cylinder;

process such signals; and generate control signals for influencing process parameters associated with an assembly of locations selected from the group consisting of the reservoir sub-assembly, the spool valve sub-assembly, the metering rod region, the tray sub-assembly, heaters, and pressure regulators.

* * * * *